US009248540B2

(12) United States Patent
Schiller

(10) Patent No.: US 9,248,540 B2
(45) Date of Patent: Feb. 2, 2016

(54) DUAL WHEEL GRINDER FOR METAL WORKPIECE

(75) Inventor: Guenter Schiller, Schwindegg (DE)

(73) Assignee: SMS LOGISTIKSYSTEME GMBH, Netphen (DE)

( * ) Notice: Subject to any disclaimer, the term of this patent is extended or adjusted under 35 U.S.C. 154(b) by 33 days.

(21) Appl. No.: 13/703,016

(22) PCT Filed: Jun. 18, 2011

(86) PCT No.: PCT/EP2011/003030

§ 371 (c)(1), (2), (4) Date: Dec. 31, 2012

(87) PCT Pub. No.: WO2012/019668

PCT Pub. Date: Feb. 16, 2012

(65) Prior Publication Data

US 2013/0143475 A1 Jun. 6, 2013

(30) Foreign Application Priority Data

Jul. 19, 2010 (DE) ..... 10 2010 027 561

(51) Int. Cl.
*B24B 27/04* (2006.01)
*B24B 7/12* (2006.01)
*B24B 7/26* (2006.01)

(52) U.S. Cl.
CPC ... *B24B 7/12* (2013.01); *B24B 7/26* (2013.01); *B24B 27/04* (2013.01)

(58) Field of Classification Search
CPC ..... B24B 7/02; B24B 7/12; B24B 5/38; B24B 9/002; B24B 27/0015; B24B 27/0084; B24B 7/26; B24B 41/002; B24B 41/047
USPC ..... 451/65, 190, 194, 199, 200, 363
See application file for complete search history.

(56) References Cited

U.S. PATENT DOCUMENTS

| | | | | | |
|---|---|---|---|---|---|
| 1,588,076 | A | * | 6/1926 | Wilder | 451/272 |
| 2,700,255 | A | * | 1/1955 | Meier | 451/210 |
| 2,915,113 | A | * | 12/1959 | Van Sickle et al. | 157/13 |
| 3,233,371 | A | * | 2/1966 | Stucker | 451/421 |
| 3,491,493 | A | * | 1/1970 | Deist | 451/55 |
| 3,543,446 | A | * | 12/1970 | Kilian | 451/194 |
| 3,675,372 | A | * | 7/1972 | Kushigian | 451/72 |
| 3,874,122 | A | * | 4/1975 | Ward | 451/262 |
| 3,953,943 | A | | 5/1976 | Nakaoka | |
| 4,011,689 | A | * | 3/1977 | Cozzini | 451/72 |

(Continued)

FOREIGN PATENT DOCUMENTS

| | | | |
|---|---|---|---|
| EP | 0053274 | A1 | 6/1982 |
| EP | 00553274 | A | 6/1982 |
| WO | 9622173 | A | 7/1996 |

*Primary Examiner* — Timothy V Eley
(74) *Attorney, Agent, or Firm* — Andrew Wilford

(57) ABSTRACT

The invention relates to a polishing device (1) for polishing a metal product (2), in particular a continuously cast slab, billet, or block. The aim of the invention is to achieve a high polishing rate when said metal products are polished. According to the invention, this is achieved in that the polishing device (1) has at least two polishing assemblies (3, 4), each polishing assembly (3, 4) having a mounting (5, 6) for a polishing unit (7, 8). A polishing unit has at least one polishing disk (9, 10) and a driving motor (11, 12) that drives the polishing disk (9, 10). The polishing disks (9, 10)arranged such that the rotational axes (A, B) of said disks run parallel to each other.

10 Claims, 3 Drawing Sheets

(56) References Cited

U.S. PATENT DOCUMENTS

| | | | | |
|---|---|---|---|---|
| 4,098,149 | A * | 7/1978 | Wright | 76/40 |
| 4,209,948 | A | 7/1980 | Obear | |
| 4,283,886 | A | 8/1981 | Obear | |
| 4,393,625 | A * | 7/1983 | Bloch et al. | 451/21 |
| 5,099,613 | A * | 3/1992 | Rogers, Jr. | 451/24 |
| 5,381,630 | A * | 1/1995 | Kinner | 451/63 |
| 5,924,911 | A | 7/1999 | Bralander | |
| 6,062,950 | A * | 5/2000 | Morgan | 451/28 |
| 6,875,080 | B2 * | 4/2005 | Gast et al. | 451/9 |

* cited by examiner

DUAL WHEEL GRINDER FOR METAL WORKPIECE

CROSS REFERENCE TO RELATED APPLICATIONS

This application is the US-national stage of PCT application PCT/EP2011/003030 filed 18 Jun. 2011 and claiming the priority of German patent application 102010027561.1 itself filed 19 Jul. 2010.

FIELD OF THE INVENTION

The invention relates to a grinding apparatus for grinding a metal workpiece, in particular a continuously cast slab, a billet, or an ingot.

BACKGROUND OF THE INVENTION

After continuous casting, continuously cast workpieces, slabs in particular, are generally given a surface treatment in order to achieve a sufficient level of quality during the subsequent processing of the workpiece. When the continuously cast slabs are ground, the slab is typically moved with a reciprocating motion back and forth longitudinally under a grinding apparatus (grinder). At the end of each stroke, the grinding apparatus is stepped transversely until the entire surface of the slab has been ground. The slab is supported on a grinding table resting lengthwise on its broad face.

EP 0 053 274 describes a generic apparatus as known in the prior art for grinding slabs.

In so-called HP grinding (high-pressure grinding) of the slab, a sufficient grinding removal rate must be achieved for reasons of economic efficiency. The material-removal rate can be increased here by increasing the width of the grinding wheel if the driving output of the motor is increased simultaneously (for example from 315 kW to 630 kW while doubling the width of the grinding wheel); this approach thus allows the specific motor output to be maintained as the same level relative to the width of the grinding wheel. However, the grinding wheel is limited by the strength of the binder of the grinding wheel; it is not possible in practice to use grinding wheels greater than 150 mm in width.

A known approach is therefore to employ, in particular, two grinding wheels side-by-side on a grinding spindle. The disadvantage of this approach, however, is the fact that the contact zone between grinding wheel and workpiece to be ground io wanders across the width of the grinding wheel, and in fact the contact zone wanders periodically back and forth from each outer edge of the grinding wheel to the center of the grinding wheel due to the reversing of the slab. Widening the contact zone and increasing the drive output thus do not necessarily produce the desired increase in the material removal rate, but may result merely in increasing the service life of the grinding wheel(s).

As a result, it cannot be assumed that using double grinding wheels on a drive spindle will also yield a doubling of the material removal rate.

OBJECT OF THE INVENTION

The object of this invention is therefore to create a grinding apparatus in which the above-descried increase in the drive output directly results in an increase in the material removal rate. Accordingly, the purpose is to improve the economic efficiency of the grinding process when grinding metal workpieces such as slabs, billets, and ingots.

SUMMARY OF THE INVENTION

This object is achieved according to the invention by an approach wherein the grinding apparatus includes at least two grinders, each grinder includes a mount for the grinding unit, each grinding unit includes at least one driven grinding wheel, and the grinding wheels are arranged such that their axes of rotation run parallel to each other.

Each mount is preferably pivotal about an axis that is parallel to the rotation axis of the grinding wheel and has an offset from this wheel. Means can be provided here to allow the offset to be adjusted between the pivot axis of the mount and the rotation axis of the grinding wheel. These means for setting the offset can be advantageously provided in the form of an eccentric.

In alternative solution, provision is made whereby each mount includes a linear guide by which the grinding wheel can be displaced perpendicular to the rotation axis of the grinding wheel, and preferably horizontally.

Each grinder can furthermore include a biaser to apply a predefined pressure of the grinding wheel against the metal workpiece, the biaser comprising, in particular, a grinding-pressure-cylinder-piston system.

The grinders can be pivoted together about an axis that is perpendicular to the rotation axis of the grinding wheels and vertical, the pivot axis being preferably in the region of the grinding wheels, in particular between the grinding wheels of the two grinders.

The grinding wheels are preferably directly next to each other. They can have different grits and/or structures.

Each grinding wheel can be driven by a respective drive motor preferably directly without intermediate gearing or other elements.

The proposed solution achieves the result that increasing the drive output of the grinding apparatus directly produces a proportional increase in the material-removal performance (material removal rate). In other words, it becomes possible to distribute the grinding performance over the grinding wheels in such a way that each grinding wheel has its own separate contact zone.

BRIEF DESCRIPTION OF THE DRAWING

An embodiment of the invention is shown in the drawing. Therein.

SPECIFIC DESCRIPTION OF THE INVENTION

Figure 1:
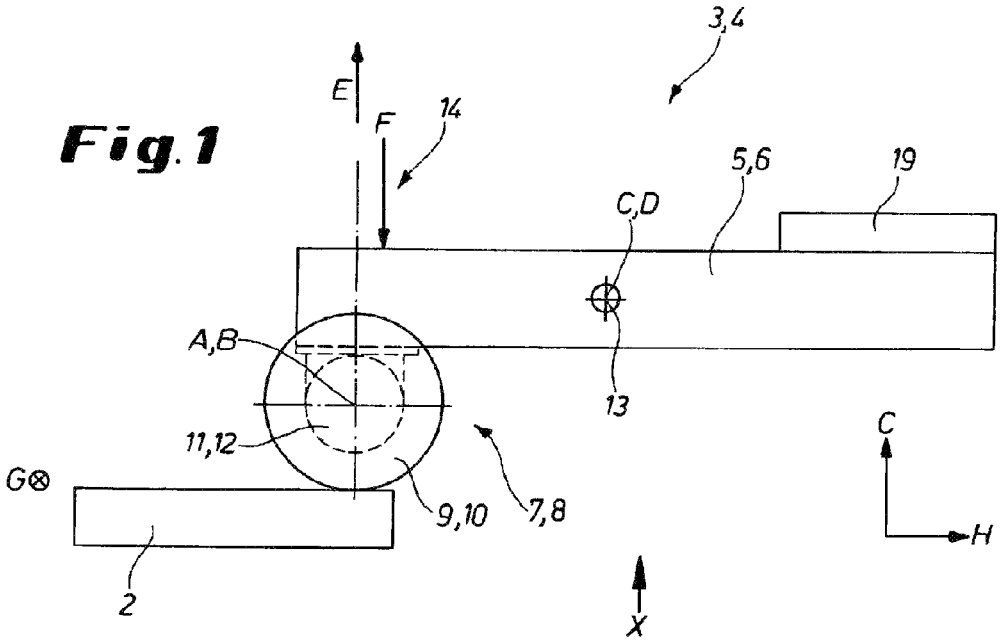
FIG. 1 is a schematic side view of the grinder of a grinding apparatus.
Figure 2:
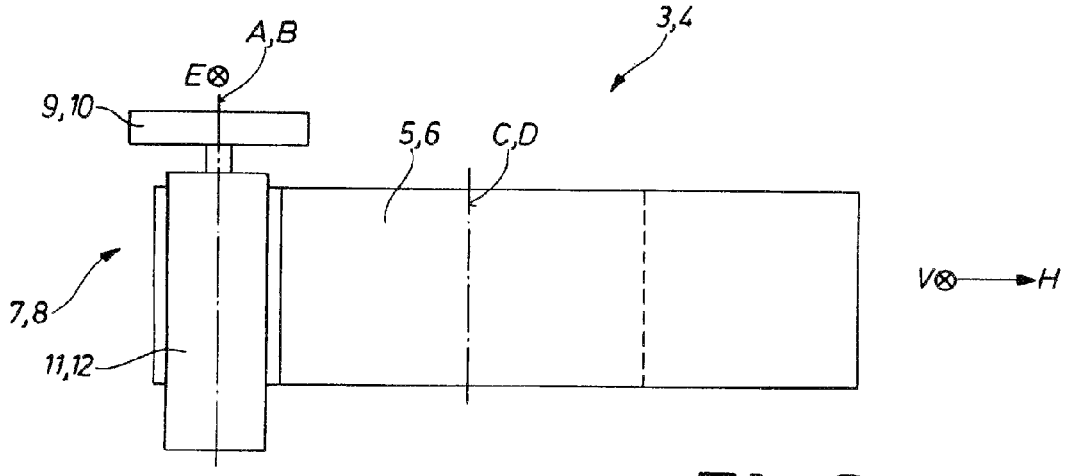
FIG. 2 is a schematic view in direction X of the grinder of FIG. 1.
Figure 3:
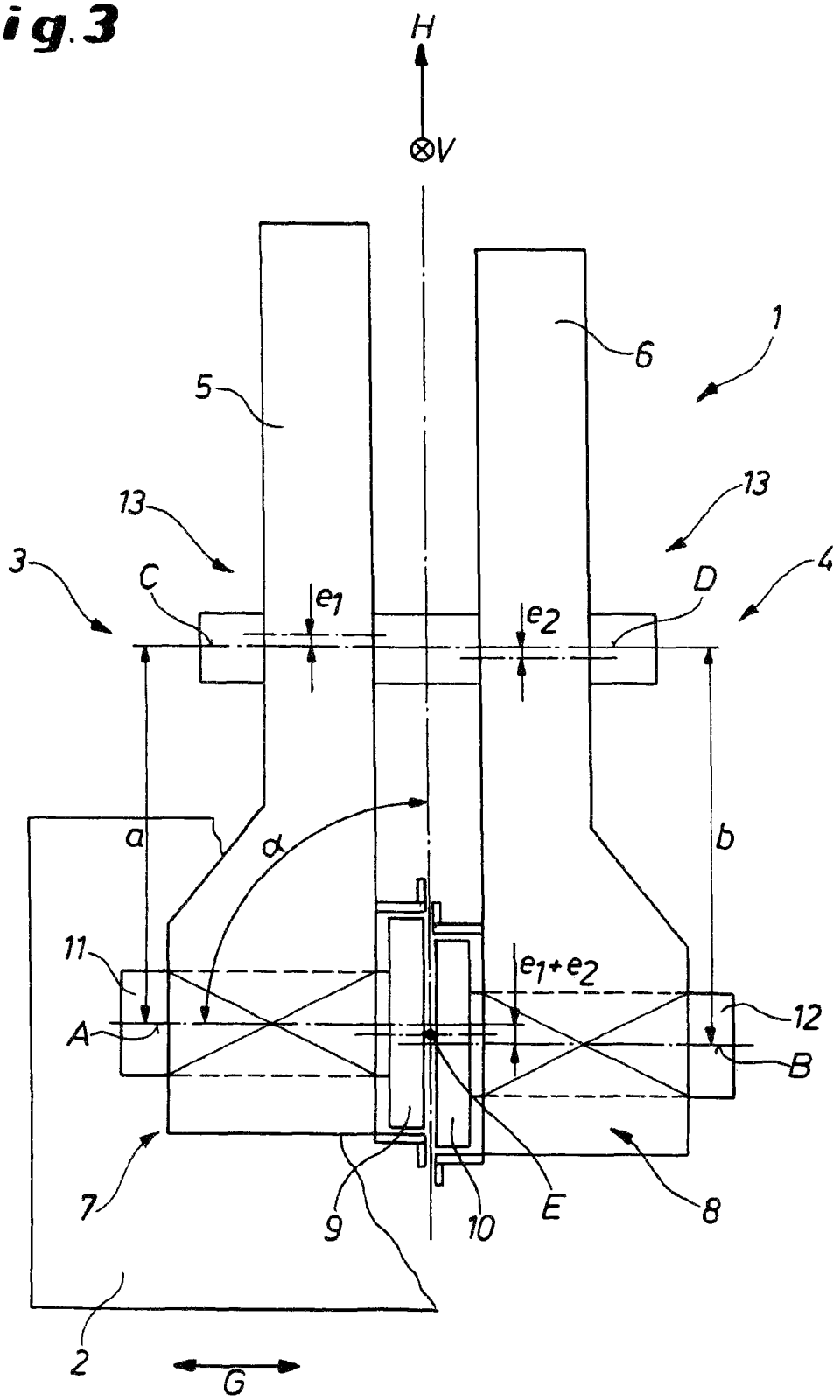
FIG. 3 is a schematic top view of a grinding apparatus with two grinders.

FIGS. 1 and 2 show a grinder 3, 4 that is a component part of a grinding apparatus 1 that is shown in FIG. 3.

The grinder 3, 4 includes a mount 5, 6 that is comprised of a floating bracket with a counterweight 19. The mount 5, 6 is pivotal about a pivot axis C, D. The grinder 3, 4 includes a grinding unit 7, 8 with grinding wheel 9, 10 driven directly by a drive motor 11, 12. The grinding wheel rotates about a rotation axis A, B.

A biaser 14, which is shown here only schematically, is a piston-cylinder system, and exerts the desired pressing force F on the metal workpiece 2.

Also indicated in outline are means here formed by respective eccentrics 13 that can change the offset between the pivot axes C, D and the respective rotation axes A, B. In this case, the rotation axes A, B can be shifted in a horizontal direction H relative to the respective pivot axes C, D by the eccentric 13.

The workpiece to be ground, i.e. the metal workpiece 2, is reciprocated back and forth, as indicated by the direction G of motion of workpiece 2.

FIG. 3 shows the entire grinding apparatus 1, again showing the direction G of motion that the workpiece 2 executes during a grinding stroke. It is evident that the two mounts 5, 6, i.e. the two floating brackets, are parallel to each other, and a respective grinding unit 7, 8 each with a grinding wheel 9, 10 is at the end of each of the brackets. The positions of the grinding wheel 9, 10 can be changed in the horizontal direction by the eccentric 13 that is indicated only in outline; i.e., the offset a or b between the pivot axis C or D of the mount 5, 6 relative to the rotation axis A or B of the grinding wheel 9, 10 can be modified slightly. The displacement created by the eccentric 13 in the horizontal direction H is shown at $e_1$ or $e_2$. If the two eccentrics of the two mounts 5, 6 are adjusted in opposite directions, as viewed in the horizontal direction H, an offset results for the grinding wheels 9, 10 in the horizontal direction H that is the sum of $e_1$ and $e_2$.

In addition, provision is made whereby the entire grinding apparatus 1 can pivot about an axis E that extends in a vertical direction V. The pivot angle relative to the longitudinal axis (extending perpendicular to the pivot axis C, D, and here pointing in the horizontal direction H) is indicated at a and here is 90° . The center of rotation E is located here between the two grinding wheels 9, 10.

Figure 4:
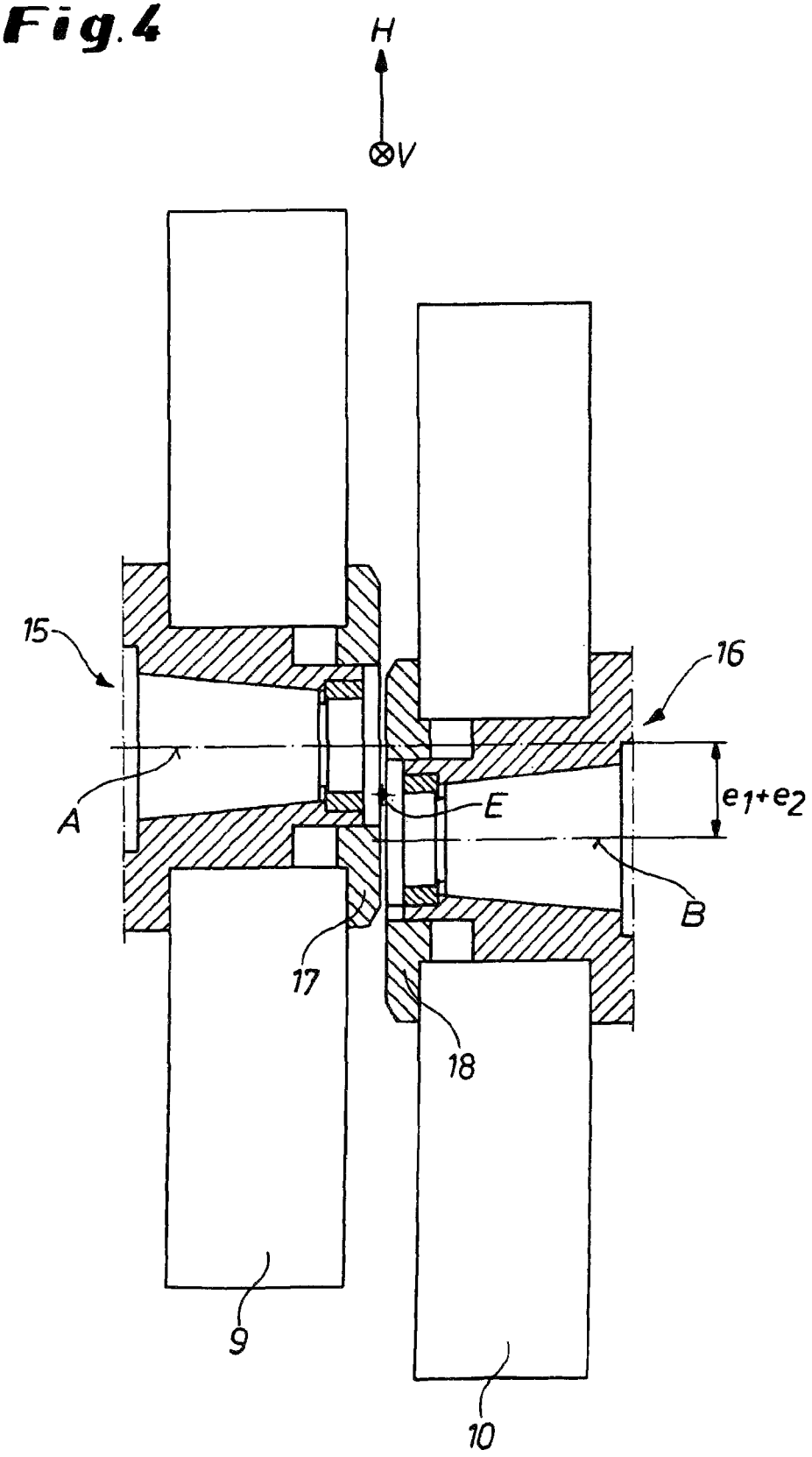
FIG. 4 is an enlarged view of the region of the grinding wheels of the grinding apparatus in FIG. 3.

FIG. 4 illustrates that the goal is to set the two grinding wheels 9, 10 as close as possible to each other. The grinding wheels 9, 10 are mounted on respective supports 15, 16. The grinding wheels 9, 10 are secured in place by respective fastening rings 17, 18. Only a small gap exists between the two fastening rings 17, 18. The smallest possible offset is thus found between the two grinding wheels 9, 10, which offset is limited by the width of the fastening rings 17, 18, and by a small clearance between them.

When, in particular, grinding is performed at an angle a between zero and 90° (preferably, between 45° and)90° , the two grinding wheels 9, 10 grind one behind the other, each with separate contact zones for the workpiece 2.

If the two (or more) grinding wheels are equipped with different grits and/or structures, this advantageously also enables two operations to be effected in parallel simultaneously. The grinding wheel 9 can thus first perform a rough-grinding operation that is followed by the finishing operation that is performed by the grinding wheel 10 with a finer grit.

Direct drive of the grinding wheels 9 and 10 is preferably provided, each wheel 9 and 10 being mounted on the drive shaft of a respective (electric or hydraulic) drive motor.

Provision can also be made whereby the drive is indirect via gears, V-belts, spindles, etc.

It should be noted in this regard that a grinding unit with its own motor is preferably provided for each grinder. It is also conceivable for a single drive motor to drive the at least two grinding wheels in the event the above-referenced indirect drive mode is provided.

If the purpose is to perform a defect grinding operation or another special grinding operation, provision can be made for using only a single grinding wheel.

Each of grinding units 7, 8 can be equipped with more than one grinding wheel 9, 10.

The invention claimed is:

1. An apparatus for grinding a cast metal workpiece, the apparatus comprising:

a pair of adjacent mounts each pivotal about a respective mount axis;

respective grinding wheels immediately adjacent each other and rotatable on the mounts about respective horizontal axes that are parallel to and offset transversely from each other as well as parallel to and offset from the respective mount axes; and drive means for rotating the wheels about the respective axes when engaging the workpiece.

2. The grinding apparatus defined in claim 1, further comprising:

means for varying an offset between the pivot axes of the mounts and the rotation axes of the respective grinding wheels.

3. The grinding apparatus defined in claim 2, wherein the means for varying is an eccentric.

4. The grinding apparatus defined in claim 1, further comprising:

respective biasing means for pressing the grinding wheels against the metal workpiece with a predetermined force.

5. The grinding apparatus defined in claim 4, wherein the biasing means includes a cylinder-piston system.

6. The grinding apparatus defined in claim 1, wherein the grinding wheels have different grits or structures.

7. The grinding apparatus defined in claim 1, wherein the drive means includes respective drive motors connected directly to the respective grinding wheels.

8. An apparatus for grinding a cast metal workpiece, the apparatus comprising:

a pair of adjacent mounts;

respective grinding wheels immediately adjacent each other and rotatable on the mounts about respective horizontal axes that are parallel to and offset transversely from each other;

drive means for rotating the wheels about the respective axes when engaging the workpiece; and means for pivoting each of the mounts with the respective wheel about a vertical axis perpendicular to the rotation axes of the grinding wheels.

9. The grinding apparatus defined in claim 8, wherein each mount is pivotal about an axis that is parallel to the rotation axis of the respective grinding wheel and is offset therefrom.

10. The grinding apparatus defined in claim 8, wherein the vertical axis is between the grinding wheels.

* * * * *